US005331721A

United States Patent [19]

Raum, Sr.

[11] Patent Number: 5,331,721

[45] Date of Patent: Jul. 26, 1994

[54] UNIVERSAL BELT CLIP

[76] Inventor: Jeffrey S. Raum, Sr., 446 Henryton S., Laurel, Md. 20707

[21] Appl. No.: 72,088

[22] Filed: Jun. 7, 1993

[51] Int. Cl.[5] ..... A45F 5/00; A44B 21/00

[52] U.S. Cl. ..... 24/3 L; 24/304; 24/326

[58] Field of Search ..... 24/3 L, 3 R, 3 G, 3 J, 24/301, 304, DIG. 11, 563, 163 K; 248/205.3; 224/252, 269

[56] References Cited

U.S. PATENT DOCUMENTS

| | | | |
|---|---|---|---|
| 2,586,740 | 2/1952 | Swanson | 224/252 |
| 3,294,229 | 12/1966 | McConnell et al. | 24/67.9 |
| 3,309,052 | 3/1967 | Borisof | 24/304 |
| 3,315,325 | 4/1967 | Cornelius | 24/DIG. 11 |
| 3,491,971 | 1/1970 | Fisher | 248/205.3 |
| 3,516,631 | 6/1970 | Santucci | 248/205.3 |
| 3,631,568 | 1/1972 | Wolfe | 24/326 |
| 4,915,215 | 4/1990 | Brekke | 24/3 L |
| 5,056,197 | 10/1991 | Cohen | 24/304 |
| 5,178,354 | 1/1993 | Engvall | 24/3 L |

*Primary Examiner*—Victor N. Sakran
*Attorney, Agent, or Firm*—Robert Halper

[57] ABSTRACT

A universal thermoplastic U clip adapted to be fastened to the apparel of a user and having a pressure sensitive adhesive affixed to one of its legs for supporting diverse semi-flat non-porous articles. The article is fastened to the adhesive by moderate pressure and is permanently secured.

6 Claims, 1 Drawing Sheet

UNIVERSAL BELT CLIP

BACKGROUND OF THE INVENTION

The present invention relates to apparatus designed to carry various articles about the belt, waist, pocket or pants.

The prior art discloses a number of devices to perform this function. Many of these devices seem to have been designed for a specific purpose in mind. For example, U.S. Pat. No. 3,453,696 is a clip for holding neckties. U.S. Pat. No. 3,763,646 is device for securing a timepiece to a belt. U.S. Pat. No. 4,165,826 is a holster releasably secured to a belt wherein the holster has a pocket member for a gun. U.S. Pat. No. 4,771,927 is a cordless phone holder having a clip secured to a belt and U.S. Pat. No. 4,953,770 shows a clip that could be attached to a shirt pocket or a belt for securing a cue holder. Common to all these fastening devices is the use of hook and ply material such as velcro for fastening the desired material to the clip.

The present invention is directed to a carrying device for various semi-flat non-porous articles such as transistor radios, baby monitors, cordless phones, tools, etc. The device of this invention can also be attached at the customary areas such as a belt, pocket, waist band or pants, is of very simple design, and requires no accessories for attachment other than what is present on the device itself.

SUMMARY OF THE INVENTION

The present invention is directed to what is described as a universal clip. The clip is in the form of a perfectly symmetrical U-clip made of a plastic material. On one surface of the clip is a pad of sticky pressure sensitive adhesive, whose surface is protected when not in use by a non-adherent liner. This particular plastic is made from a thermoplastic sheet sold under the trade name Kydex. Kydex is a solid polymer which is not considered hazardous under normal usage and handling. It is classified as an organometal compound with a polyvinylidene/acrylic mix. The sticky adhesive is manufactured by the 3M Company and is an acrylic adhesive and is in the form of a urethane foam tape material which is double coated. Its features include high ultimate bond strength, very good high temperature and solvent resistance, very high shear holding powers and to twelve months' shelf life at 70° F. and 50% humidity. Once the non-adherent liner is removed a semi-flat non-porous surface may be anchored to the tape by applying a moderate amount of pressure. Once the article is fastened to the clip, it is permanently fixed.

It is therefore an object of this invention to provide a universal clip that can be attached to a user's apparel to secure a semi-flat non-porous material.

It is a further object of this invention to provide a universal clip that is sturdy, durable and contains on one side thereof a pressure sensitive adhesive.

It is still an object of this invention to provide a universal clip that is made of plastic, is simple to produce and contains an adhesive tape that does not require any accessory adherent surface to secure diverse flat, non-porous articles, It is also an object of this invention to use a universal clip that has a pressure sensitive adhesive which will permanently secure the article to be attached.

DETAILED DESCRIPTION OF THE INVENTION

Figure 1:
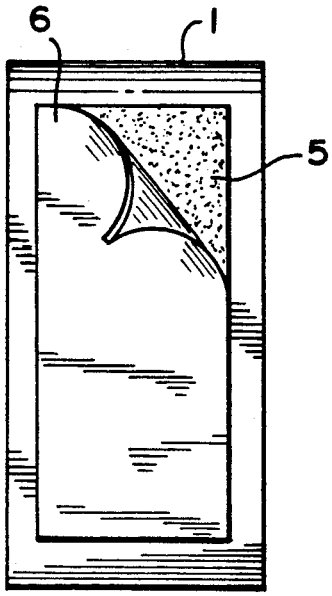
FIG. 1 is a frontal view of the universal clip.
Figure 2:
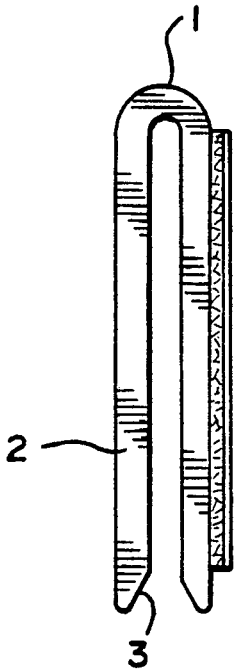
FIG. 2 is a side view of the universal clip.
Figure 3:
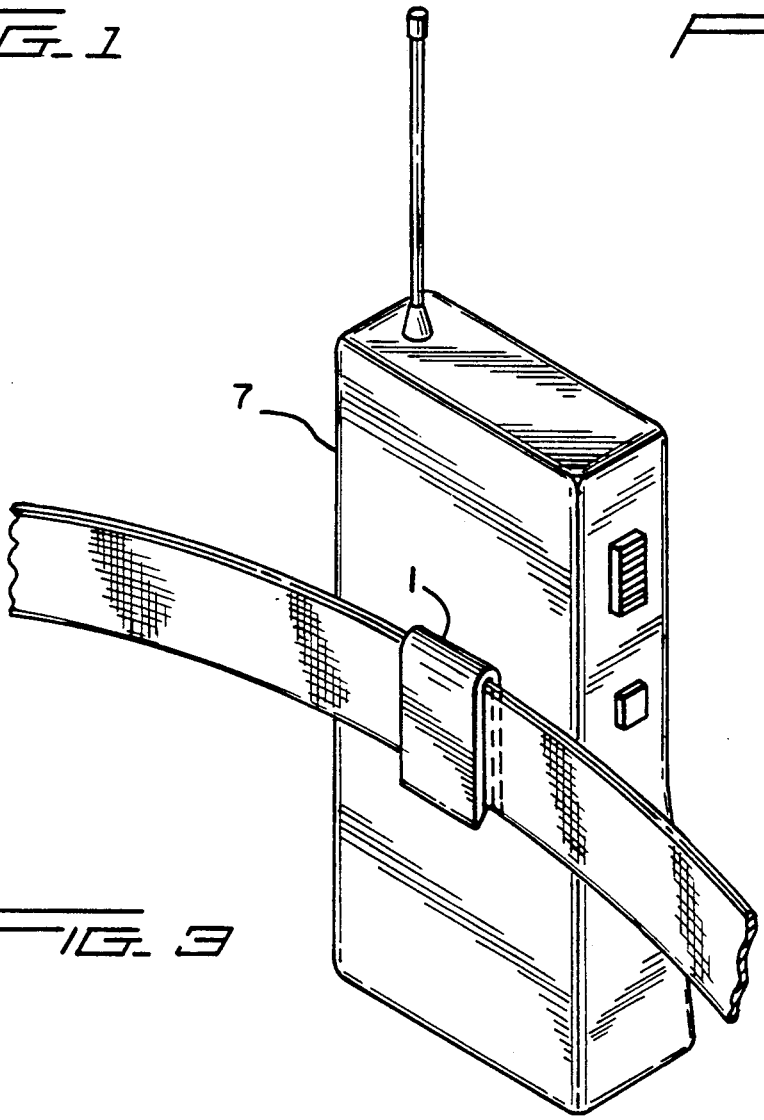
FIG. 3 is a view showing the attachmemnt of a walkie-talkie to the clip which is affixed to a belt.

As seen in FIG. 1 universal clip 1 is a symmetrical U shaped member. The clip has legs 2 with beveled ends 3. The bevel extends inwardly and upwardly at an angle of about 45° and to a height of about ¼". The beveled ends are buffed so as to obviate any sharp edges. The space between the two legs of the U can vary from about ⅛" to about ¼". Whatever its dimension, it is always equal for the extent of the legs. The clip measures about 2" in length and is about 1" wide. The clip is made of a thermoplastic material, preferably a thermoplastic sold under the trade name Kydex. Kydex is a solid polymer such as a polyvinylidene/polyacrylic mix containing an organically combined metal such as tin, It also contains the usual lubricants, stabilizers and pigments. It is produced in the form of a sheet of various thicknesses from which the clip is then made. It is a resilient material, not considered hazardous in normal usage and handling, but precautions must be taken when machining to keep dust concentrations below 5 mg/m$^3$. Across the width of one of the legs is secured a pressure sensitive adhesive. This adhesive is in the form of a rectangular pad 5 which measures about 1½" in length, ¾" wide and ¼" thick. The pad adheres firmly to the leg of the clip and is covered by a protective liner 6 whose outer face is non-adherent and having the same dimensions as the pad. The adhesive is a double coated foam tape material, manufactured by the 3M Co. and is as described above an acrylic adhesive. In use the universal clip is attached to a user's apparel such as a shirt pocket, belt, waistband, pants pocket, etc. and the article to be secured is pressed onto the foam tape by applying a moderate amount of pressure and after removal of the non-adherent cover. The tape has sufficient strenth against tension and shear such that it can adequately accommodate articles up to 10 pounds weight. Once the article is secured to the clip, it is permanently in place and cnanot be removed by ordinary pressure or force. FIG. 3 illustrates the universal clip supporting a flat, non-porous surface such as a walkie-talkie 7, although other articles such as cordless phones, baby monitors, transistor radios, mini-tv's, voltmeters, tools, keys, etc can similarly be supported.

The instant invention herein describes a preferred embodiment of the invention. It is to be understood by those skilled in the art that various modifications and alterations may be made within the scope of this invention and therefore the invention is not limited to specific details disclosed herein. Other embodiments will occur to those skilled in the art and are within the scope of the following claims.

I claim:

1. A universal U clip having means for connection to the apparel of a user, said means comprising a clip having symmetrical parallel legs of equal length, said legs being equidistant for the extent of their length, said clip being made of a thermoplastic resilient material, said legs having outer sides and a pressure sensitive adhesive adhered to one of said outer sides for a substantial portion of said side, said clip directly supporting a non-porous semi-flat material on one of said legs having said pressure sensitive adhesive, said adhesive having a protective liner when not in use.

2. A universal U clip as in claim 1 wherein said semi-flat non-porous article is selected from a walkie-talkie, a trnasistor radio, a cordless telephone, a baby monitor, a voltmeter, a tool and said clip is connected to a belt.

3. A universal clip as in claim 1 wherein said pressure sensitive adhesive is a foam tape in the form of a rectangular pad that occupies a substantial portion of said leg.

4. A universal U clip as in claim 3 wherein said thermoplastic material is a polyvinylidene/acrylic mix having an organotin component, (sold under the trade name Kydex) and said foam tape is a double coated urethane.

5. A universal clip as in claim 4 wherein said semi-flat, non-porous article is fastened to said tape by the application of a moderate amount of pressure against the tape, said article being permanently supported by said clip, said tape having adhesive strngth to support about ten pounds.

6. A universal clip as in claim 1 wherein said clip measures 2" in length, 1" in width, the distance between the leg varies from ⅛" to ¼", said legs having downwardly facing ends with a 45° bevel that is buffed and extends inwardly and upwardly to a height of about ¼", said foam type being about ¼" thick.

* * * * *